US009340977B2

(12) United States Patent
Nanayakkara

(10) Patent No.: US 9,340,977 B2
(45) Date of Patent: May 17, 2016

(54) MULTI-ELEMENT CONSTRUCTIONAL ASSEMBLY FOR JOIST GIRDERS

(71) Applicant: Lakdas Nanayakkara, Boca Raton, FL (US)

(72) Inventor: Lakdas Nanayakkara, Boca Raton, FL (US)

( * ) Notice: Subject to any disclaimer, the term of this patent is extended or adjusted under 35 U.S.C. 154(b) by 0 days.

(21) Appl. No.: 14/689,902

(22) Filed: Apr. 17, 2015

(65) Prior Publication Data

US 2015/0259912 A1 Sep. 17, 2015

Related U.S. Application Data

(63) Continuation of application No. 14/456,766, filed on Aug. 11, 2014, now abandoned, and a continuation-in-part of application No. 12/940,211, filed on Nov. 5, 2010, now abandoned, and a continuation-in-part of application No. 11/116,092, filed on Apr. 27, 2005, now abandoned.

(51) Int. Cl.

| | |
|---|---|
| ***E04C 3/07*** | (2006.01) |
| ***E04C 3/06*** | (2006.01) |
| ***E04C 3/04*** | (2006.01) |

(52) U.S. Cl.

CPC ... *E04C 3/06* (2013.01); *E04C 3/04* (2013.01); *E04C 3/07* (2013.01); *E04C 2003/0404* (2013.01); *E04C 2003/0413* (2013.01); *E04C 2003/0473* (2013.01)

(58) Field of Classification Search

CPC ..... E04C 3/07; E04C 3/06; E04C 3/04; E04C 3/29

USPC ..... 52/729.3, 690, 696, 634, 650.1, 220.2, 52/220.4, 220.8, 783.17, 798.1, 202

See application file for complete search history.

(56) References Cited

U.S. PATENT DOCUMENTS

| | | | | | |
|---|---|---|---|---|---|
| 101,015 | A | * | 3/1870 | Holms | 52/840 |
| 634,692 | A | * | 10/1899 | Lanz | 52/838 |
| 854,391 | A | * | 5/1907 | Voshardt | 52/840 |
| 2,029,645 | A | * | 2/1936 | Waugh | 52/377 |
| 2,101,090 | A | * | 12/1937 | Palmer | 52/210 |
| 3,037,593 | A | * | 6/1962 | Webster | 52/476 |
| 3,300,839 | A | * | 1/1967 | Lichti | 29/897.35 |
| 4,329,824 | A | * | 5/1982 | Lowe | 52/634 |
| 4,409,771 | A | * | 10/1983 | Lowe | 52/840 |
| 4,490,958 | A | * | 1/1985 | Lowe | 52/634 |
| 4,734,146 | A | * | 3/1988 | Halcomb et al. | 156/148 |

(Continued)

*Primary Examiner* — Adriana Figueroa
*Assistant Examiner* — Jessie Fonseca
(74) *Attorney, Agent, or Firm* — Melvin K. Silverman

(57) ABSTRACT

A construction system for joist girders, includes a pair of opposing bi-planar sheets of structural material, each bi-planar sheet having two alternating series of vertical segments, each segment of the series, in horizontal cross-section, defining a planar base parallel to a base of a successive vertical segment of the alternating series of vertical segments, the bases of each segment of the series integrally connected to each other by sidewalls. Respectively upper and lower horizontal track members define in transverse cross-section, a substantially U-shaped geometry, each track member open-ended for horizontally enclosing and securing an upper edge of each bi-planar sheet of the pair of bi-planar sheets. Several vertical tubular members define, in transverse cross-section, a geometry of a rectangle, said tubular members disposed between the pair of bi-planar sheets and nested within corrugated thereof. Tubular horizontal members each having a partially cut-out lower surface are proportioned for engagement about respective edge areas of the bi-planar sheets.

5 Claims, 5 Drawing Sheets

(56) References Cited

U.S. PATENT DOCUMENTS

| | | | | | |
|---|---|---|---|---|---|
| 5,012,626 | A * | 5/1991 | Spelten | 52/840 |
| 5,165,213 | A * | 11/1992 | Finch et al. | 52/588.1 |
| 5,417,022 | A * | 5/1995 | Ritchie | 52/309.13 |
| 5,852,908 | A * | 12/1998 | Nankin | 52/838 |
| 6,170,217 | B1 * | 1/2001 | Meyer | 52/693 |
| 6,205,725 | B1 * | 3/2001 | Butler | 52/292 |
| 6,415,577 | B1 * | 7/2002 | Curtis | 52/840 |
| 2003/0041547 | A1 * | 3/2003 | Gosselin | 52/630 |
| 2004/0040252 | A1 * | 3/2004 | Beral et al. | 52/729.3 |
| 2008/0141612 | A1 * | 6/2008 | Schierding | 52/634 |

* cited by examiner

MULTI-ELEMENT CONSTRUCTIONAL ASSEMBLY FOR JOIST GIRDERS

CROSS REFERENCE TO RELATED APPLICATIONS

This application is a continuation-in-part of application Ser. No. 14/456,766, filed Aug. 11, 2014, which is a continuation-in-part of application Ser. No. 12/940,211, filed Nov. 5, 2010, now abandoned which is a continuation-in-part of application Ser. No. 11/116,092, filed Apr. 27, 2005, now abandoned, all of which are incorporated hereinto in their entireties.

FIELD OF THE INVENTION

The present invention relates to a constructional joist girder having corrugated internal central surfaces.

BACKGROUND OF THE INVENTION

Use of light gauge metal as an element in a wall, floor or roof assembly has had only limited use, which has generally been that of end supports or foundation elements in a position transverse to the end of a support beam or the like. The same is reflected in such references as U.S. Pat. No. 6,205,727 (2001) to Butler, entitled Interlocking Corrugated Panel Wall Cast In-Situ.

The present invention recognizes the potential application of so-called light gauge metal, i.e., steel, aluminum or alloy metal having a gauge in a range of about 0.5 to about 18 mm. for the formation of a surface having a repetitive sequence of ridges and grooves, e.g., corrugations. Therein, such elements are employed as a center support means and truss substitute within a larger constructional assembly in the nature of an internal part of a floor or ceiling structure. The prior art does not, to the knowledge of the inventor, suggest such a constructional assembly or the use of corrugated light gauge steel in such a fashion.

The truss 16 of the U.S. Pub. Patent Appln. 2008/0141612 to Schierding is not a structure similar in function to that of my system. Schierding claims no feature comparable to my fasteners in which a substantially horizontally disposed upper elongate collar-like members are independently fastened to both a hollow re-enforcing member and opposing bi-planar sheets. As such, the sheets, track members and hollow elongate re-enforcing members are mutually secured and are thereby maintained in close proximity to each other, minimizing the potential effect of any bending moments caused by gravity or direct impacts. That is, my system functions to *diffuse* or transfer shear forces from the center to the edges of the supporting substructure. In distinction, the structure of Schierding employs two distinct securement cavities, namely, an interior chamber and a region formed at ends of its leg members which are bent outwardly to lie against chords to support a second cavity for a meniscus along ends of the leg members by which a web apex is held. As such, the re-enforcing element is separated from the apex by a considerable distance, referred to in Schierding as a throat portion.

In my system, apart from the differences in use, namely, that of a girder joist of a floor or ceiling versus that of a load-bearing wall in Schierding, the opportunity for such bending moments of shear forces is minimized in that the edges of a planar sheet extend well into the interior of a longitudinal track-like enclosure in combination with the fastener from opposite directions of an open bottom of member to the edges of a bi-planar sheet by the fasteners and an upper area of the enclosure to a re-enforcing member.

Stated otherwise, the system of Schierding does not define a unitary or integrated mechanical system in which each part co-acts in a structurally supportive way with its other parts. Further, given the undulating character of its web, there does not exist an integral securement to the upper or lower edges of the upper interior chamber of the structure. Due to factor welds are necessary to secure the web to each chord. My structure, in distinction, provides a continuous interface of securement of the longitudinal tracks to the bi-planar sheets in addition to the shear force transfer function of the fasteners, discussed above. This structure alone provides a more predictable result than that obtainable by simply substituting a bi-planar surface for the undulating web configuration of Schering. That is, the distance of the re-enforcing element from the apex of the web inherently degrades the stability of the system particularly if it were used with a corrugated geometry of the type of Palmer (U.S. Pat. No. 2,101,090) as a simple substitute for a web of a truss.

In economic terms, the girder structure of Schierding, however combined with Palmer, is not cost-effective for use in load bearing joist girder applications such as substructure of a wall or ceiling as is contemplated herein.

SUMMARY OF THE INVENTION

A construction system for joist girders, including includes a pair of opposing bi-planar sheets of structural material, each bi-planar sheet having two alternating series of vertical segments, each segment of the series, in horizontal cross-section, defining a planar base parallel to a base of a successive vertical segment of the alternating series of vertical segments, the bases of each segment of the series integrally connected to each other by sidewalls. Respectively upper and lower horizontal track members define in transverse cross-section, a substantially U-shaped geometry, each track member open-ended for horizontally enclosing and securing upper and lower edge areas of each bi-planar sheet of the pair of bi-planar sheets. Several vertical tubular members define, in transverse cross-section, a geometry of a rectangle, said tubular members vertically disposed between the pair of bi-planar sheets and nested within corrugated thereof. Tubular horizontal members each having a partially cut-out lower surface are proportioned for engagement about respective edge areas of the bi-planar sheets.

It is an object of the invention to provide a composite constructional assembly in which a corrugated surface of gauge metal thinner than 0.375 inch is secured between upper and lower elements of a material such as gauge metal and wood, with a corrugation pitch or depth of about 20 to about 450 mm.

It is another object to provide a joist girder assembly of the above type, said surface of corrugated narrow gauge steel may be provided with a plurality of holes or apertures sufficient to permit passage of utilities such as wires, conduits, and water lines therethrough.

It is a further object to provide a joist girder assembly that can be employed in or between a ceiling and floor, including a joist portion thereof.

The above and yet other objects and advantages of the present invention will become apparent from the hereinafter set forth Brief Description of the Drawings, Detailed Description of the Invention and claims appended herewith.

DETAILED DESCRIPTION OF THE INVENTION

Figure 1:
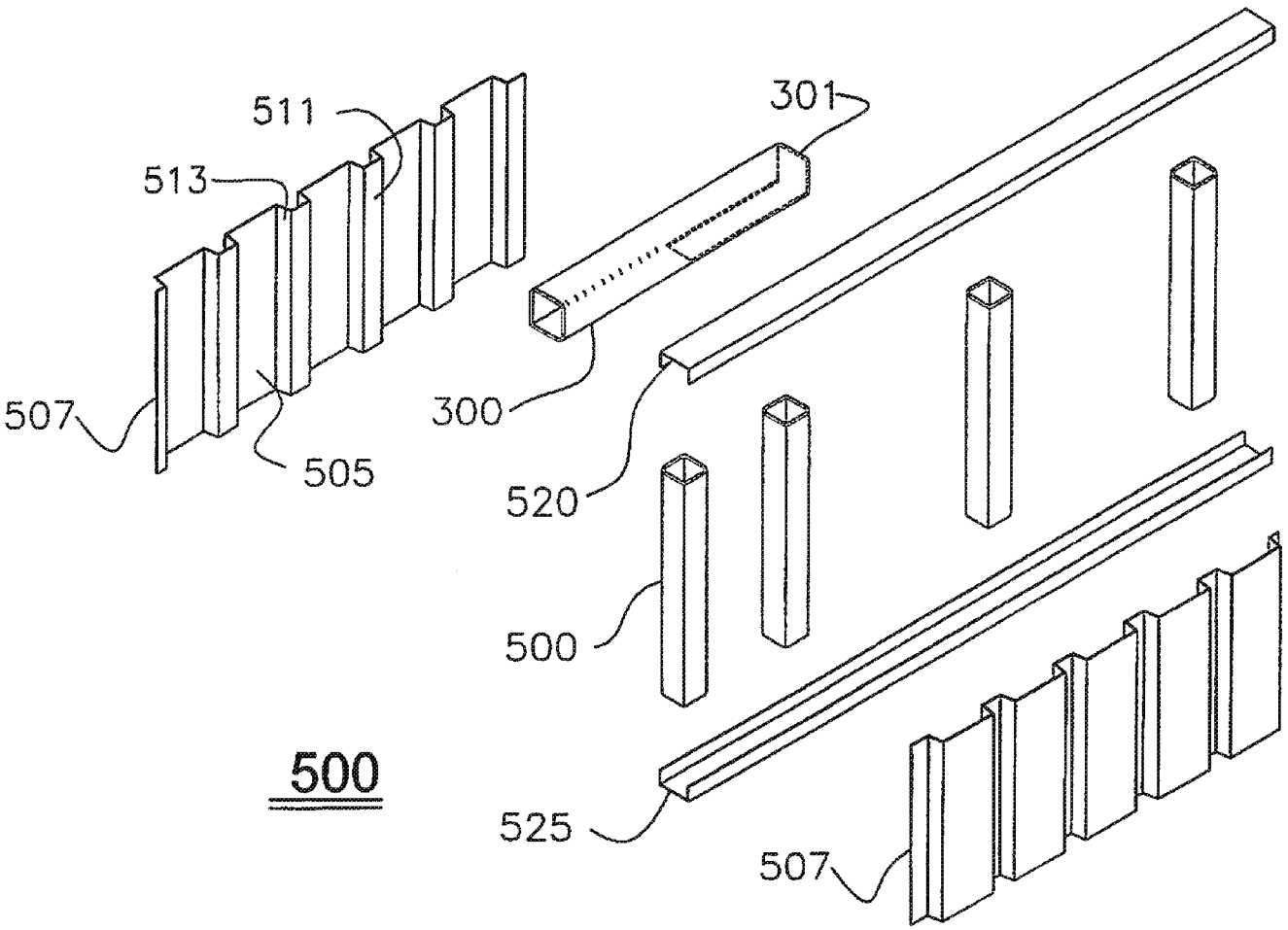
FIG. 1 is an exploded isometric view of the invention.

FIGS. 1-8 illustrate various views of an embodiment of the invention in which there is provided a multi-element construction system including two corrugated bi-planar sheets 505 and 507 which need not be equal in width or depth of the corrugated thereof. Said embodiment of the invention further includes a pair of hollow horizontal tubular members 300 (see FIGS. 1 and 8), as well as multiple hollow vertical tubular members 500 which are particular to the instant invention. The hollow tubular members 300 and 500 define, in transverse cross-section, a polygonal geometry, inclusive of a rectangular geometry. An upper longitudinal track 520 defines a U-shape on three sides, and holds the horizontal upper edge areas of bi-planar sheets 505 and 507 when joined, this in the manner shown particularly in FIGS. 2 to 7. As may be noted in the assembly views of FIGS. 2A, 2B and 3 and, particularly, the enlarged region thereof shown in FIG. 3, all surfaces of hollow vertical members 500 are enclosed by the bi-planar geometry of sheets 505 and 507 when joined together by upper and lower metal tracks 520 and 525.

As may be noted, each left and right tubular horizontal member 300 entails a cut-away portion 301 (see FIGS. 1, 3 and 8) which permits it to envelop each end of the upper metal track 520. Further, as may be noted in views of FIGS. 5-7, screws 509 and 515, or equivalent fasteners, secure the respective front and back bi-planar sheets 505 and 507 to vertical tubes 500 and, similarly, are used (see FIGS. 4 and 5), to secure the bi-planer sheets 505/507 to the longitudinal tracks 520 and 525. The relationship between vertical tubular members 500, upper and lower U-shaped longitudinal tracks 520 and 525, and bi-planer sheets of 505 and 507 may be seen with reference to vertical transverse cross-sectional view of FIGS. 4-7.

Thereby, there is set forth herein a construction system for a joist girder including a pair of bi-planar sheets 505 and 507 of structural material, each bi-planar sheet having two alternating series 510 and 511 of vertical segments (see FIG. 1), each segment of the series, in horizontal cross-section, defining a virtual plane parallel to a virtual plane of a successive vertical segment of said alternating series 510/511 of vertical segments, said bases of each segment of said series integrally connected to each other by sidewalls 513 having a pitch as set forth above (see FIGS. 1 and 2).

The system also includes a pair of said respective upper and lower horizontal tracks 520/525, defining in, transverse cross-section, a substantially U-shaped geometry (see FIGS. 4 and 5), each member being open-ended, for horizontally enclosing and securing an edge areas of each sheet of said pair of bi-planar sheets 505/507. Also included is a plurality of said vertical tubular members 500 (see FIGS. 3 and 6) preferably defining, in transverse cross-section, a geometry of a rectangle, each vertical member being disposed between said pair of bi-planar sheets. (See FIGS. 2 and 3.) Further included are said vertical members 500 defining, in transverse cross-section, a geometry of a rectangle, an upper portion of each member 500 disposed inside at least one horizontal track of each of said pair of tracks 520/525.

Figure 2A:
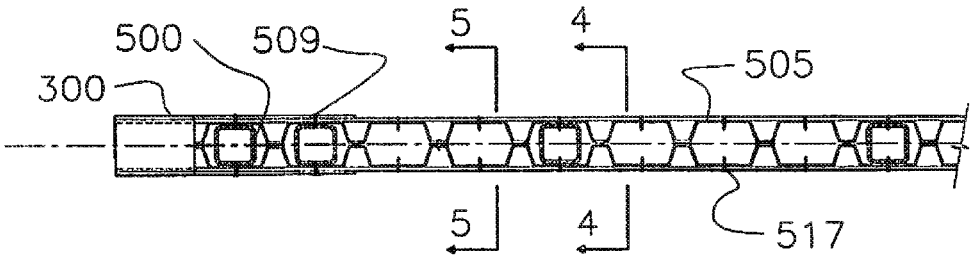
FIGS. 2A and 2B are top assembly views of opposite ends of the embodiment of FIG. 1.
Figure 2B:
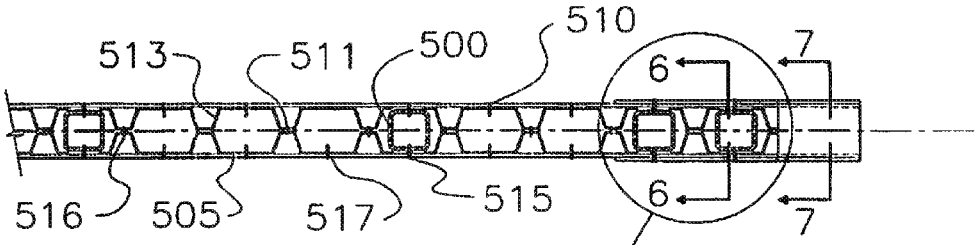
Figure 3:
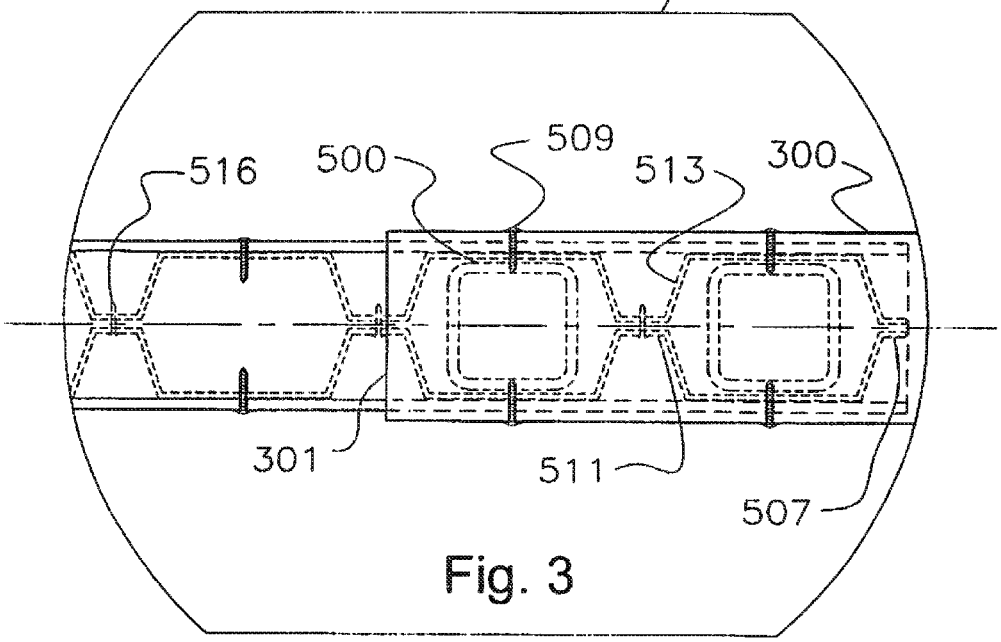
Figure 4:
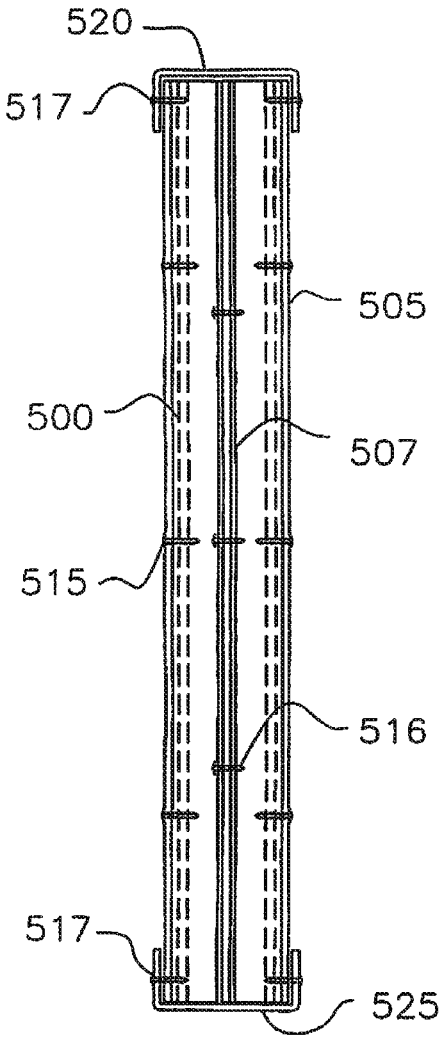
FIGS. 4, 5 and 6 and 7 are sectional views of FIGS. 2A and 2B taken along Lines 4-4, 5-5, 6-6 and 7-7 thereof.
Figure 5:
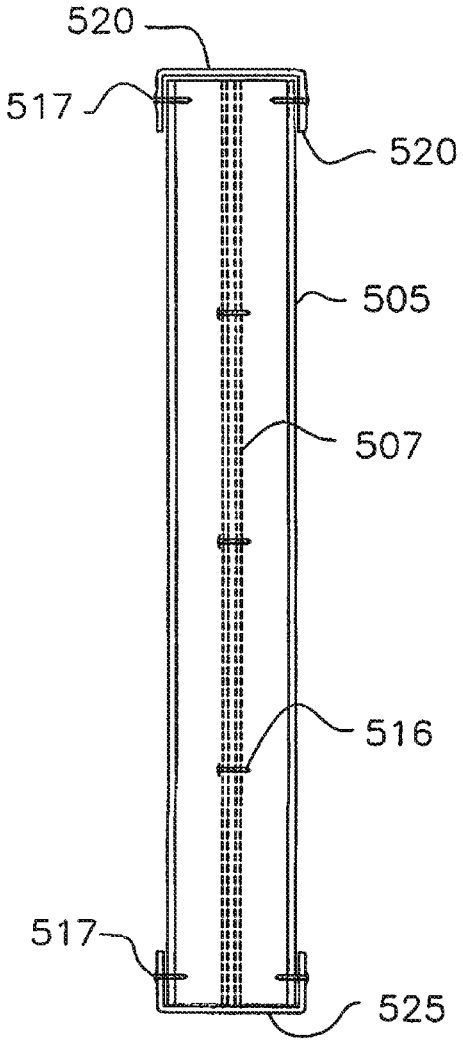
Figure 6:
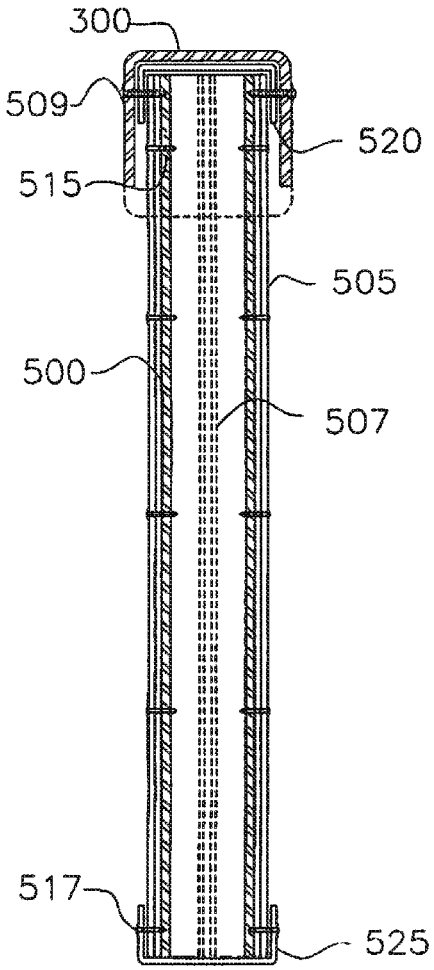
Figure 7:
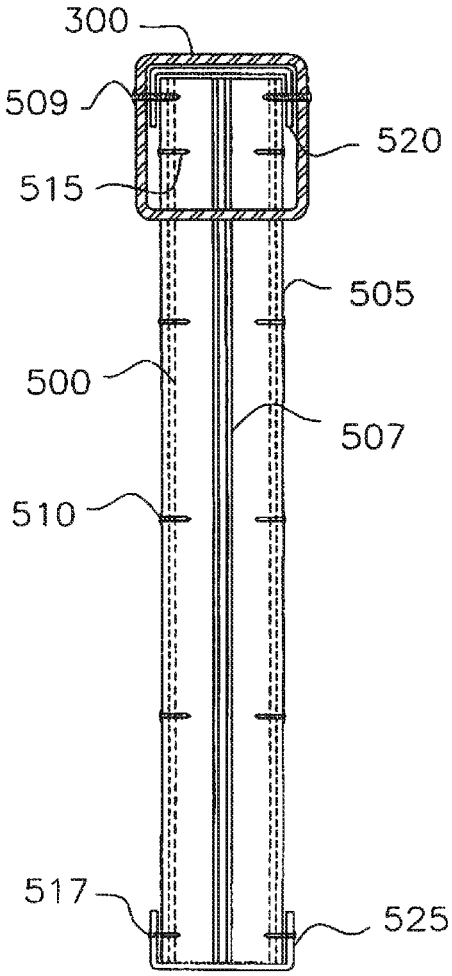
Figure 8:
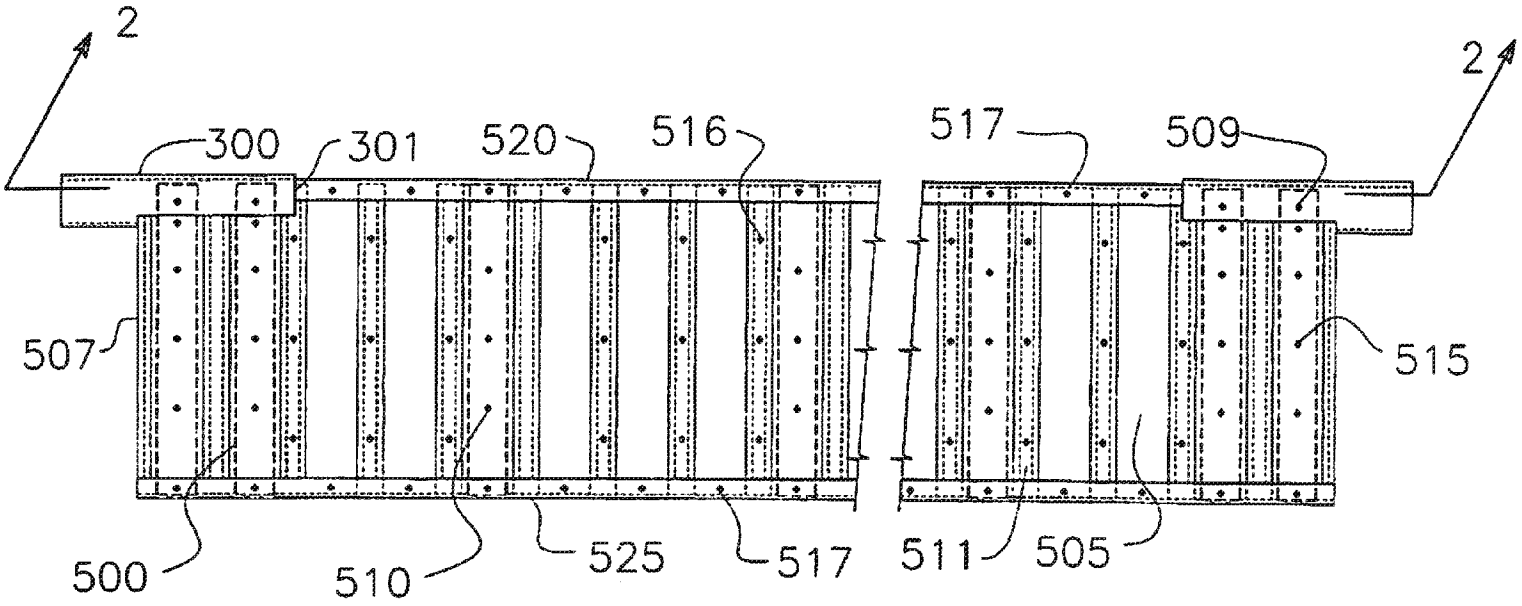
FIG. 8 is a front elevational views of the view of FIGS. 2A and 2B

Shown in FIGS. 3-5 is the manner in which fasteners 509 secure horizontal tracks 520/525 to corrugated sheets 505/507 and said sheets to vertical members 500. The number of vertical members 500 used per corrugated recess 510 of each sheet 505/507 is shown in FIGS. 2A and 2B. FIGS. 6-7 show the manner of securement of tubes 300 to the upper areas of sheets 505/507, using fasteners 515.

Accordingly, there is provided a joist girder assembly that can be effectively employed or between a ceiling of floor of a building.

While there has been shown and described the preferred embodiment of the instant invention it is to be appreciated that the invention may be embodied otherwise than is herein specifically shown and described and that, within said embodiment, certain changes may be made in the form and arrangement of the parts without departing from the underlying ideas or principles of this invention as set forth in the Claims appended herewith.

The invention claimed is:

1. A joist girder construction system, comprising:

(a) a pair of bi-planar sheets of structural material, each of said bi-planar sheets having two alternating series of vertical segments, each segment of each series, in horizontal cross-section, defining a planar base parallel to a base of a successive vertical segment of said alternating series of vertical segments, said planar bases of each segment of said alternating series integrally connected to each other by sidewalls;

(b) respective upper and lower horizontal tracks, each defining in, transverse cross-section, a substantially U-shaped geometry, each track open-ended for enclosing and securing respective upper and lower edge areas of both bi-planar sheets of said pair thereof;

(c) a plurality of vertical members, each of said members vertically disposed between said pair of bi-planar sheets and nested within opposing corrugations thereof; and (d) respective left and right tubular horizontal member defining in cross-section, a geometry of a polygon, an inner portion of each horizontal member having a partially cut-out lower surface proportioned for engagement about respective left and right edge areas of said upper track.

2. The system as recited in claim 1, in which a horizontal width of each base of one of said series of said vertical segments differs from that of said bases of the other of said series of said vertical segments.

3. The system as recited in claim 1, in which at least one of horizontal tracks is horizontally secured to a portion of said bi-planar sheets via a plurality of metal fasteners or welds.

4. The system as recited in claim 1, in which at least a portion of each of said left and right horizontal members comprise a solid member.

5. The system as recited in claim 1, in which said vertical members comprise:

tubular elements.

* * * * *